US010337188B2

(12) United States Patent
Diamond et al.

(10) Patent No.: US 10,337,188 B2
(45) Date of Patent: Jul. 2, 2019

(54) RETROFIT FRAMING SYSTEM FOR METAL ROOF

(71) Applicant: Garland Industries, Inc., Cleveland, OH (US)

(72) Inventors: Thomas G. Diamond, Cleveland, OH (US); Qumrul Hasan, Cleveland, OH (US); John L. Pierson, Cleveland, OH (US)

(73) Assignee: Garland Industries, Inc., Cleveland, OH (US)

( * ) Notice: Subject to any disclaimer, the term of this patent is extended or adjusted under 35 U.S.C. 154(b) by 85 days.

(21) Appl. No.: 15/933,952

(22) Filed: Mar. 23, 2018

(65) Prior Publication Data

US 2018/0209150 A1 Jul. 26, 2018

Related U.S. Application Data

(62) Division of application No. 15/227,282, filed on Aug. 3, 2016, now Pat. No. 10,006,205.

(60) Provisional application No. 62/201,675, filed on Aug. 6, 2015.

(51) Int. Cl.

| | |
|---|---|
| ***E04D 3/36*** | (2006.01) |
| *E04B 7/18* | (2006.01) |
| *E04D 3/24* | (2006.01) |

(52) U.S. Cl.

CPC ..... *E04D 3/3608* (2013.01); *E04B 7/18* (2013.01); *E04D 3/24* (2013.01)

(58) Field of Classification Search

CPC .... E04D 2001/3414; E04D 2001/3452; E04D 2001/3488; E04D 3/24; E04D 1/34; E04B 7/04; E04B 7/18

See application file for complete search history.

(56) References Cited

U.S. PATENT DOCUMENTS 1,998,688 A * 4/1935 Robinson ..... E04B 2/76 52/241
3,008,550 A * 11/1961 Miles ..... E04B 2/7455 52/210
4,397,127 A * 8/1983 Mieyal ..... E04B 2/789 52/241
4,757,657 A * 7/1988 Mitchell ..... E04B 2/7409 403/12
4,936,067 A * 6/1990 Menchetti ..... E04B 2/766 52/241
5,685,121 A * 11/1997 DeFrancesco ..... E04C 3/07 52/241
5,735,100 A * 4/1998 Campbell ..... E04B 1/3447 52/126.6
5,875,592 A * 3/1999 Allman ..... E04D 3/3608 52/198

(Continued)

FOREIGN PATENT DOCUMENTS

CA 2420736 A1 * 9/2004 ..... E04B 1/24

*Primary Examiner* — Babajide A Demuren
(74) *Attorney, Agent, or Firm* — Fay Sharpe LLP

(57) ABSTRACT

An improved sub-structural roof construction component which provides support for exterior building metal roofing materials, which allows for standard components designed and manufactured in factory to be installed at jobsite, and which can accommodate variations required in the field. These framing components can be adjusted in field for height and can be rotated to fit the customer's roof design slope.

31 Claims, 4 Drawing Sheets

(56) References Cited

U.S. PATENT DOCUMENTS

| | | | | |
|---|---|---|---|---|
| 6,088,982 | A * | 7/2000 | Hiesberger | E04B 1/2608 403/231 |
| 6,240,682 | B1 * | 6/2001 | James | E04B 7/024 52/712 |
| 7,856,763 | B2 * | 12/2010 | Keys | E04B 7/045 403/232.1 |
| 7,918,054 | B2 * | 4/2011 | Grafton | E04B 7/02 248/291.1 |
| 8,074,416 | B2 * | 12/2011 | Andrews | E04B 2/767 403/230 |
| 2017/0037630 | A1 * | 2/2017 | Diamond | E04D 1/34 |

* cited by examiner

RETROFIT FRAMING SYSTEM FOR METAL ROOF

CROSS-REFERENCE TO RELATED APPLICATIONS

This application is a divisional application of U.S. Ser. No. 15/227,282 filed Aug. 3, 2016, which in term claims priority to U.S. Provisional Patent Application Ser. No. 62/201,675, filed Aug. 6, 2015. The entirety of that application is hereby fully incorporated by reference.

The present invention relates to framing assemblies, particularly to framing assemblies for roofing systems, and more particularly to a sub-structural framing assembly capable of providing support for a new roofing system over an existing roofing system of a building.

BACKGROUND ON THE INVENTION

Roofing structures can be constructed using a number of different methods and roofing systems. One system, commonly used for retrofit roofs, is the post and purlin system which includes a plurality of vertical posts connected to the existing roof system. Connected to an upper end of the vertical posts are horizontal purlins that run perpendicular to the vertical posts in the horizontal plane. Various roofing components can be connected to the purlins.

Sub-structural framing assemblies can be used to support the construction of a new roofing system over an existing roofing system. However, existing framing assemblies suffer many disadvantages, such as, for example, 1) an inability to vertically adjust the height of the framing assembly, and/or 2) an inability to freely rotate a portion of the framing assembly to provide a desired pitch and/or slope of the new roofing system.

Non-limiting examples of prior art framing assemblies are present in U.S. Pat. Nos. 5,875,592; 7,918,054; and US 2001/0025458, which are all incorporated herein by reference.

In view of the prior art, there remains a need for an improved framing assembly having a vertically adjustable height, having a free pitch rotation, and which can support exterior building roofing materials over an existing roof.

SUMMARY OF THE INVENTION

The present invention is directed to an improved apparatus and method regarding the creating of sub-framing for a roof, more particularly to a framing assembly, particularly to framing assemblies for roofing systems, more particularly to a sub-structural framing assembly capable of providing support for a new or retrofit roofing system over an existing roofing system of a building, even more particularly to a sub-structural framing assembly capable of providing support for a new or retrofit metal roofing system over an existing roofing system of a building, and still even more particularly to a sub-structural framing assembly capable of providing support for a new or retrofit sloped metal roofing system over an existing roofing system of a building. Generally, this improved framing system can be used on new or retrofit roofing projects requiring a stable and flexible sub-framing.

In accordance with a non-limiting embodiment of the present invention, there is provided a framing assembly which can be connected to the existing roof structure of a building, and which can be configured to provide structural support for one or more exterior building roofing materials, wherein the exterior building roofing materials are part of a new roofing system. The sub-structural roof construction component can also or alternatively be configured to allow for standard components designed and manufactured in a factory to be installed at a jobsite. The sub-structural roof construction component can also or alternatively be configured to accommodate variations required in the field. The sub-structural roof construction component can also or alternatively be configured to be adjustable in the field for height and/or can be configured to be rotatable to fit the customer's roof design slope.

In another and/or alternative non-limiting aspect of the present invention, there is provided a framing assembly having a top shaped element, a first vertical web element, a second vertical web element, and a base plate element. One or more of the top shaped elements, first vertical web elements, second vertical web elements, and/or base plate element can be movable (i.e., linearly, rotationally, etc.) relative to each other; however, this is not required.

In another and/or alternative non-limiting aspect of the present invention, the framing assembly includes a top shaped element. The top shaped element is generally configured to 1) provide a mounting surface to which the exterior building roof material and/or roof system can be connected, and/or 2) be at least partially rotatable so as to fit a desired roof slope. As such, the top shaped element can provide a means of connecting an overlaying roof system to the framing assembly. As can be appreciated, the top shaped element can have other or additional functions. In one non-limiting configuration, the top shaped element is connected at a first end to the overlaying roofing system, and at a second end to the first vertical web element. In one specific non-limiting configuration, the top shaped element is configured to be attached to the first vertical web element at the top end (i.e., the end facing away from ground-level); however, this is not required. Generally, a specially designed fixed hinge and/or friction fit fasteners can optionally be used to maintain the desired rotational position of the top shaped element; however, this is not required. As can be appreciated, other and/or additional connection arrangements can be used. In one non-limiting arrangement, the top shaped element is pivotally connected to the first vertical web element by a rotational connection element (e.g., bolt, rivet, pin or other structure); however, this is not required. The top shaped element can also include a securing element that is spaced from the rotational connection element and is configured to secure the top shaped element in a specific position relative to the first vertical web element so as to inhibit or prevent rotation of the top shaped element relative to the first vertical web element. As such, when the top shaped element is pivoted about the rotational connection element to a desired rotation position relative to the first vertical web element, the securing element can be used to maintain the top shaped element in such position. If the top shaped element needs to be rotatable adjusted, the securing element can optionally be configured to allow the top shaped element to be rotated relative to the first vertical web element and then resecure the top shaped element in the adjusted position.

The size, shape and material of the top shaped element are non-limiting. In one non-limiting configuration, the material used to form the top shaped element is a rigid material, such as, for example, metal material; however, other or alternative materials can be used (e.g., plastic material, composite material, sheet metal, aluminum, extruded aluminum, light-gauge metal, heavy-gauge metal, steel, stainless steel, galvanized steel, ceramic material, wood, etc.). In one non-limiting configuration, the top shaped element can be configured to include a first horizontal portion, a vertical portion, and a second horizontal portion; however, this is not required. At can be appreciated, the top shaped element can only include a first horizontal portion and a vertical portion. In one non-limiting configuration, the first horizontal portion lies in a plane that is generally perpendicular (e.g., 80-100° and all values and ranges therebetween) to the plane of the vertical portion; however, this is not required. As can be appreciated, the plane of the first horizontal portion can lie in a different angle relative to the vertical portion. When a second horizontal portion is included on the top shaped element, the second horizontal portion lies in a plane that is generally perpendicular (e.g., 80-100° and all values and ranges therebetween) to the plane of the vertical portion; however, this is not required. As can be appreciated, the plane of the second horizontal portion can lie in a different angle relative to the vertical portion.

In another and/or alternative non-limiting aspect of the present invention, the first horizontal portion of the top shaped element can be formed in a generally planar, rectangular shape, and is configured to be positioned parallel to the second horizontal portion when the second horizontal position is included on the top shaped element; however, this is not required. In one non-limiting configuration, the first horizontal portion is configured to be spaced apart from the second horizontal portion; however, this is not required. In another and/or alternative non-limiting configuration, an end and/or surface of the first horizontal portion can include a connection arrangement provided thereon; however, this is not required. The connection arrangement (when used) can be configured to facilitate the attachment of the new roof system to the framing assembly; however, this is not required. The second horizontal portion of the top shaped element (when used), can be formed in a generally planar, rectangular shape; however, this is not required. The first and/or second horizontal portions can be used to provide structural strength to the top shaped element; however, this is not required. The top shaped element can be formed of a single piece or by multiple pieces. The top shaped element can be formed of a single material or by multiple materials. The vertical portion of the top shaped element can be formed in a generally planar, rectangular shape; however, this is not required. The cross-sectional shape of the top shaped element is non-limiting (e.g., L-shaped, C-shaped, U-shaped, [-shaped, Z-shaped, etc.). In one non-limiting configuration, the cross-sectional shaped of the top shaped element is L-shaped, C-shaped, U-shaped, or [-shaped. In another non-limiting configuration, the top shaped element is Z-shaped. In such a configuration, the vertical portion can be connected at an angle, such as, for example a 45° angle, at a first end to an end of the first horizontal portion, and at a second end to an end of the second horizontal portion, thereby providing a generally Z-shaped top shaped element; however, this is not required. As can be appreciated, the angle between the vertical portion and 1) the first horizontal portion, and/or 2) the second horizontal portion can be the same or different, however is generally configured to fit various roof types as needed.

In another and/or alternative non-limiting aspect of the present in invention, the vertical portion of the top shaped element can be configured to include one or more holes and/or apertures for the purpose of receiving one or more fasteners (e.g., screws, nails, bolts, clips, pins, etc.); however, this is not required. The one or more holes and/or apertures (when used) are not limited in size and/or shape. The one or more holes and/or apertures can be configured to facilitate one or more fasteners as said one or more fasteners are secured through the vertical portion of the top shaped element. Typically, the one or more holes and/or apertures are provided on a portion of the vertical portion behind which the first vertical web element is provided; however, this is not required. In another non-limiting configuration, the vertical portion of the top shaped element has a first and second hole and/or aperture; however, this is not required. In still another non-limiting configuration, one or more surfaces of the top shaped element can have one or more surface structures, such as, for example, bumps, ridges, grooves, plateaus, etc.; however, this is not required.

In another and/or alternative non-limiting configuration, the top shaped element can optionally include a second vertical portion. The second vertical portion (when used) can be formed in a generally planar, rectangular shape, can be spaced from the first vertical portion, and can be connected to the first and/or second horizontal portions. When a second vertical position is used, the cross-sectional shaped of the top shaped element can be O-shaped, oval shape, D-shape, P-shape, B-shaped, etc.). The second vertical portion (when used) can provide structural strength and/or rigidity to the top shaped portion; however, this is not required.

The top shaped element is not limited in size. In one non-limiting configuration, the height of the top shaped element can be from about 2 inches to about 30 inches, more typically from about 3 inches to about 20 inches, and more typically from about 4 inches to about 12 inches. In another and/or alternative non-limiting configuration, the width of the top shaped element can be from about 1 inch to about 30 inches, more typically from about 2 inches to about 25 inches, and more typically from about 3 inches to about 20 inches. In still another and/or alternative non-limiting configuration, the length of the top shaped element can be from about 6 inches to about 84 inches, more typically from about 8 inches to about 72 inches, and more typically from about 12 inches to about 60 inches. In still yet another and/or alternative non-limiting configuration, the thickness of the material used to form the top shaped element can be from about 0.01 inches to about 2 inches, more typically from about 0.05 inches to about 1.5 inches, and more typically from about 0.10 inches to about 1 inch; however, this is not required. Generally, the length of the top shaped portion is greater than the height or width of the top shaped portion. Generally, the height of the top shaped portion is greater than the width of the top shaped portion; however, this is not required.

In another and/or alternative non-limiting aspect of the present invention, the framing assembly includes a first vertical web element. The first vertical web element is generally configured to 1) provide a vertical load transfer from the roofing component, and/or 2) provide a vertically adjustable height to the framing assembly; however, this is not required. As can be appreciated, the first vertical web element can have other or additional functions. In one non-limiting configuration the first vertical web element is configured to connect at a first end to the top shaped element, and at a second end to the second vertical web element or base plate element. In one specific non-limiting configuration, the first vertical web element is configured to be connected to the top shaped element at the top end (i.e., the end away from ground-level), and to be connected to the second vertical web element at the bottom end or base plate element (i.e., the end closest to ground-level); however, this is not required. The connection arrangement can optionally include special engineered hinges and/or friction fit fasteners; however, this is not required. As can be appreciated, other or additional connection arrangements can be used. The size, shape and material of the first vertical web element are non-limiting. In one non-limiting configuration, the material used to form the first vertical web element is a rigid material, such as, for example, metal material; however, other or alternative materials can be used (e.g., plastic material, composite material, sheet metal, aluminum, extruded aluminum, light-gauge metal, heavy-gauge metal, steel, stainless steel, galvanized steel, ceramic material, wood, etc.). In one non-limiting configuration, the first vertical web element can be configured to include a vertical body portion, optionally a first vertical portion, and optionally a second vertical portion; however, this is not required. The cross-sectional shape of the first vertical web portion is non-limiting (I-shaped, H-shaped, L-shaped, E-shaped, U-shaped, C-shaped, [-shaped, etc.).

In another and/or alternative non-limiting aspect of the present invention, the first vertical portion of the first vertical web element can be formed in a generally planar, rectangular shape; however, this is not required. The rectangular shape (when used) typically has first and second longitudinal edge and a first and second side edge. The first vertical portion is generally configured to be positioned parallel to the second vertical portion of the first vertical web element. In one non-limiting configuration, the first vertical portion is configured to be spaced apart from the second vertical portion; however, this is not required. In one non-limiting configuration, the first vertical portion of the first vertical web element can be configured to include one or more holes and/or apertures for the purpose of receiving one or more fasteners (e.g., screws, nails, bolts, clips, pins, etc.); however, this is not required. The one or more holes and/or apertures are not limited in size and/or shape. The one or more holes and/or apertures can be configured to facilitate one or more fasteners as the one or more fasteners are secured through the first vertical portion of the first vertical web element. In one non-limiting configuration, the one or more holes and/or apertures are provided at or near the bottom end (i.e. the end nearest to ground-level) of the first vertical portion; however, this is not required.

In another and/or alternative non-limiting aspect of the present invention, the second vertical portion of the first vertical web element can be formed in a generally planar, rectangular shape; however, this is not required. The rectangular shape (when used) typically has first and second longitudinal edge and a first and second side edge. The second vertical portion is generally configured to be positioned parallel to the first vertical portion of the first vertical web element; however, this is not required. In one non-limiting configuration, the second vertical portion of the first vertical web element can be configured to include one or more holes and/or apertures for the purpose of receiving one or more fasteners (e.g., screws, nails, bolts, clips, pins, etc.); however, this is not required. The one or more holes and/or apertures are not limited in size and/or shape. The one or more holes and/or apertures can be configured to facilitate one or more fasteners as said one or more fasteners are secured through the second vertical portion of the first vertical web element. In one non-limiting configuration, the one or more holes and/or apertures are provided at or near the bottom end (i.e., the end nearest to ground-level) of the second vertical portion of the first vertical web element; however, this is not required. The one or more holes and/or apertures can be oriented in generally the same or similar location as the one or more holes and/or apertures are oriented on the first vertical portion; however, this is not required. In such a configuration, one or more of the holes and/or apertures are positioned opposite one another on the first vertical web element; however, this is not required.

In another and/or alternative non-limiting aspect of the present invention, the vertical body portion of the first vertical web element can be formed in a generally planar, rectangular shape; however, this is not required. In one non-limiting configuration, the vertical body portion can be connected approximately perpendicularly at a first end to an end of the first vertical portion. Similarly, the vertical body portion can be connected approximately perpendicularly at a second end to the second vertical portion, said second end opposite the end where the first vertical portion and the vertical body portion meet, thereby providing a generally "U-shaped" or "C-shaped" first vertical web element; however, this is not required. In another and/or alternative non-limiting aspect of the present invention, the first vertical web element can optionally have a second vertical body portion; however, this is not required. The second vertical body portion (when used) can be formed in a generally planar, rectangular shape, and can be connected approximately perpendicularly at a first end to an end of the first vertical portion and at a second end to an end of the second vertical portion, thereby providing a generally "O-shaped" first vertical web element; however, this is not required. In one non-limiting configuration, the vertical body portion can have a hole and/or aperture provided at or near the top end (i.e. the end away from ground-level); however, this is not required. Similarly, the vertical body portion can have a slot provided at or near the top end of the vertical body portion; however, this is not required. In one non-limiting configuration, the slot has an arcuate and/or radial shape relative to the hole and/or aperture provided at the top end of the vertical body portion; however, this is not required. The slot is spaced from the hole and/or aperture. Generally, the slot can be used as a guide for the rotation of the top shaped element relative to the first vertical web element; however, this is not required. A plurality of angle markers can be provided at or near the slot for the purpose of identifying and/or setting the angel of the top shaped element relative to the first vertical web element; however, this is not required. The type of angle marker is non-limiting. Non-limiting examples of angle markers can include, but are not limited to, lines, ridges, grooves, slots, apertures, bumps, holes, etc.

The first vertical web element is not limited in size. In one non-limiting configuration, the height of the first vertical web element can be from about 2 inches to about 84 inches, more typically from about 3 inches to about 72 inches, and more typically from about 4 inches to about 60 inches. In another and/or alternative non-limiting configuration, the width of the first vertical web element can be from about 1 inch to about 24 inches, more typically from about 2 inches to about 18 inches, and more typically from about 3 inches to about 12 inches. In still another and/or alternative non-limiting configuration, the length of the first vertical web element can be from about 6 inches to about 72 inches, more typically from about 8 inches to about 60 inches, and more typically from about 12 inches to about 48 inches. In still yet another and/or alternative non-limiting configuration, the thickness of the material used to form the first vertical web element can be from about 0.01 inches to about 2 inches, more typically from about 0.05 inches to about 1.5 inches, and more typically from about 0.10 inches to about 1 inch; however, this is not required. Generally, the length of the first vertical web element is greater than the height or width of the first vertical web element; however, this is not required.

In another and/or alternative non-limiting aspect of the present invention, the framing assembly optionally includes a second vertical web element. The second vertical web element is generally configured to 1) provide a vertical load transfer from the first vertical web element, and/or 2) provide vertical height adjustment as needed in the field. As can be appreciated, the second vertical web element can have other or additional functions. In one non-limiting configuration, the second vertical web element is configured to be connected at a first end to the first vertical web element, and at a second end to be connected to the base plate element. In one specific non-limiting configuration, the second vertical web element is configured to be connected to the first vertical web element at the top end (i.e., the end away from ground-level), and to be connected to the base plate element at the bottom end (i.e., the end closest to ground-level); however, this is not required. The connection arrangement can optionally include special vertically slotted friction fit fasteners; however, this is not required. As can be appreciated, other or additional connection arrangements can be used. The size, shape and material of the second vertical web element are non-limiting. In one non-limiting configuration, the material used to form the second vertical web element is a rigid material, such as, for example, metal material; however, other or alternative materials can be used (e.g., plastic material, composite material, sheet metal, aluminum, extruded aluminum, light-gauge metal, heavy-gauge metal, steel, stainless steel, galvanized steel, ceramic, wood, etc.). In one non-limiting configuration, the second vertical web element can be configured to include a first vertical portion, a vertical body portion, and a second vertical portion. The second vertical web element is generally configured to be oriented in the vertical plane (i.e., perpendicular to the ground); however, this is not required. As can be appreciated, the second vertical web element can have other or alternate orientations. In one non-limiting configuration, the second vertical web element is configured to be positioned approximately perpendicular to the plane of the top surface of the base plate element; however, this is not required.

In another and/or alternative non-limiting aspect of the present invention, the first vertical portion of the second vertical web element can be formed in a generally planar, rectangular shape; however, this is not required. The rectangular shape (when used) typically has a first and second longitudinal edge and a first and second side edge. The first vertical portion is generally configured to be positioned parallel to the second vertical portion of the second vertical web element; however, this is not required. In one non-limiting configuration, the first vertical portion is configured to be spaced apart from the second vertical portion; however, this is not required. In one non-limiting configuration, the first vertical portion is configured to include a slot. The slots can be configured to 1) facilitate the movement of a fastener therethrough, and/or 2) provide a means of attachment of the first vertical portion of the second vertical web element to the first vertical web element; however, this is not required. As can be appreciated, the first vertical portion can include other or additional arrangements for connecting the first vertical portion to the first vertical web element. The slot is not limited in size or shape. In one non-limiting configuration, the slot is positioned approximately equidistant between the first and second side edge of the first vertical portion. In one non-limiting configuration, the slot is configured to extend from a first longitudinal end to a second longitudinal end a distance of from about 20% to about 90%, more typically from about 30% to about 85%, and more typically from about 40% to about 80%; however, this is not required.

In another and/or alternative non-limiting aspect of the present invention, the second vertical portion of the second vertical web element can be formed in a generally planar, rectangular shape; however, this is not required. The rectangular shape (when used) typically has first and second longitudinal edge and a first and second side edge. The second vertical portion is generally configured to be positioned parallel to the second vertical portion of the second vertical web element. In one non-limiting configuration, the second vertical portion is configured to include a slot. The slot can be configured to 1) facilitate the movement of a fastener therethrough, and/or 2) provide a means of attachment of the second vertical portion of the second vertical web element to the first vertical web element; however, this is not required. As can be appreciated, the second vertical portion can include other or additional arrangements for connecting the second vertical portion to the first vertical web element. The slot is not limited in size or shape. In one non-limiting configuration, the slot is positioned approximately equidistant between the first and second side edge of the second vertical portion. In one non-limiting configuration, the slot is configured to extend from a first longitudinal end to a second longitudinal end a distance of from about 20% to about 90%, more typically from about 30% to about 85%, and more typically from about 40% to about 80%; however, this is not required.

In another and/or alternative non-limiting aspect of the present invention, the vertical body portion of the second vertical web element can be formed in a generally planar, rectangular shape; however, this is not required. The vertical body portion can be positioned approximately perpendicular at a first end to the plane of the top surface of the base plate element; however, this is not required. In one non-limiting configuration, the vertical body portion can be connected approximately perpendicularly at a first end to an end of the first vertical portion. Similarly, the vertical body portion can be connected approximately perpendicularly at a second end to the second vertical portion, and the second end opposite the end where the first vertical portion and the vertical body portion meet, thereby providing a generally U-shaped or C-shaped or [-shaped vertical web element; however, this is not required. In another and/or alternative non-limiting aspect of the present invention, the second vertical web element can optionally have a second vertical body portion; however, this is not required. The second vertical body portion (when used) can be formed in a generally planar, rectangular shape, and can be connected approximately perpendicularly at a first end to an end of the first vertical portion and at a second end to an end of the second vertical portion, thereby providing a generally O-shaped or oval shaped second vertical web element; however, this is not required.

The second vertical web element is not limited in size. In one non-limiting configuration, the height of the second vertical web element can be from about 2 inches to about 84 inches, more typically from about 3 inches to about 72 inches, and more typically from about 4 inches to about 60 inches. In another and/or alternative non-limiting configuration, the width of the second vertical web element can be from about 1 inch to about 24 inches, more typically from about 2 inches to about 18 inches, and more typically from about 3 inches to about 12 inches. In still another and/or alternative non-limiting configuration, the length of the second vertical web element can be from about 6 inches to about 72 inches, more typically from about 8 inches to about 60 inches, and more typically from about 10 inches to about 48 inches. In still yet another and/or alternative non-limiting configuration, the thickness of the material used to form the second vertical web element can be from about 0.01 inches to about 2 inches, more typically from about 0.05 inches to about 1.5 inches, and more typically from about 0.10 inches to about 1 inch; however, this is not required.

In another and/or alternative non-limiting aspect of the present invention, the framing assembly includes a base plate element. The base plate element is generally configured to 1) provide an attachment to a building structural component, and/or 2) connect to the first or second vertical web element; however, this is not required. As can be appreciated, the base plate element can have other or additional functions. The base plate element is generally configured to be oriented in a horizontal plane (i.e., parallel to the ground); however, this is not required. As can be appreciated, the base plate element can have other or alternative orientations. The size, shape and material of the base plate element are non-limiting. In one non-limiting configuration, the material used to form the base plate element is a rigid material, such as, for example, metal material; however, other or additional materials can be used (e.g., plastic material, composite material, sheet metal, aluminum, extruded aluminum, light-gauge metal, heavy-gauge metal, steel, stainless steel, galvanized steel, ceramic, wood, etc.). The base plate element of the framing assembly can be formed in a generally planar, rectangular shape providing a top surface and a bottom surface; however, this is not required. A rectangular shape (when used) typically has a first and second longitudinal edge and a first and second side edge, wherein the length of the first and second longitudinal edges are about equal to or greater than the length of the first and second side edge; however, this is not required. The top surface of the base plate element can include one or more connection arrangements to connect the base plate element to the second vertical web element; however, this is not required. Typically, the first or second vertical web element can be connected approximately perpendicularly on the top surface of the base plate element; however, this is not required. The base plate element can be attached at the bottom end of the second vertical web element by a weld connection; however, this is not required. As can be appreciated, other or additional connection arrangements can be used (e.g., rivet, bolt, clamp, melted connection, etc.). The base plate element can be permanently or releasably connected to the first or second vertical web element. The bottom surface of the base plate element can include one or more connection arrangements configured to connect the base plate element to a building structural component (e.g., an existing roofing system, etc.). According to one non-limiting aspect of the present invention, the base plate element is configured to include one or more slots. The one or more slots can be configured to 1) facilitate the movement of one or more fasteners therethrough, and/or 2) provide a means of attachment of the base plate element to a building structural component; however, this is not required. As can be appreciated, the base plate element can include other or additional arrangements for connecting the base plate element to the building roof structure. The one or more slots are not limited in size or shape. In one non-limiting configuration, the base plate element has a first slot and a second slot. The first slot can be positioned at or near a first side edge of the base plate element and positioned generally parallel to said first side edge. Similarly, the second slot can be positioned at or near a second side edge of the base plate element, said second side edge being opposite the first side edge, and can be positioned generally parallel to a second side edge. The first and second slots can be about the same in length; however, this is not required. In one non-limiting configuration, the first and second slots are configured to extend from a first longitudinal end to a second longitudinal end of the base plate element a distance of from about 10% to about 90%, more typically from about 20% to about 85%, and more typically from about 30% to about 80%; however, this is not required.

The base plate element is not limited in size. In one non-limiting configuration, the width of the base plate element can be from about 2 inches to about 72 inches, more typically from about 3 inches to about 60 inches, and more typically from about 4 inches to about 48 inches. In another and/or alternative non-limiting configuration, the length of the base plate element can be from about 2 inch to about 72 inches, more typically from about 3 inches to about 60 inches, and more typically from about 4 inches to about 48 inches. In another and/or alternative non-limiting configuration, the thickness of the material used to form the base plate element can be from about 0.01 inches to about 2 inches, more typically from about 0.05 inches to about 1.5 inches, and more typically from about 0.10 inches to about 1 inch; however, this is not required.

In another and/or alternative non-limiting aspect of the present invention, the framing assembly includes a base track element. The base track element is generally configured to 1) provide an adjustable attachment to a building structural component, and/or 2) connect to the first or second vertical web element; however, this is not required. As such, the base track element can provide a means of connecting the framing assembly to a building structural component; however, this is not required. As can be appreciated, the base track element can have other or additional functions. The base track element is generally configured to be oriented in the horizontal plane (i.e. parallel to the ground); however, this is not required. As can be appreciated, the base track element can have other or alternative orientations. The size, shape and material of the base track element are non-limiting. In one non-limiting configuration, the material used to form the base track element is rigid material, such as, for example, metal material; however, other or alternative materials can be used (e.g. plastic material, composite material, sheet metal, aluminum, extruded aluminum, light-gauge metal, heavy-gauge metal, steel, stainless steel, galvanized steel, ceramic, wood, etc.). In one non-limiting configuration, the base track element can be configured to include a first vertical portion, a horizontal portion, and a second vertical portion; however, this is not required. The base track element is generally configured to be oriented in the horizontal plane (i.e., parallel to the ground); however, this is not required. As can be appreciated, the base track element can have other or alternative orientations.

In another and/or alternative non-limiting aspect of the present invention, the first vertical portion of the base track element can be formed in a generally planar, rectangular shape, and can be configured to be positioned parallel to the second vertical portion; however, this is not required. In one non-limiting configuration, the first vertical portion is configured to be spaced apart from the second vertical portion; however, this is not required. In another and/or alternative non-limiting configuration, an end and/or surface of the first vertical portion can include a connection arrangement provided thereon for the purpose of at least partially connecting a portion of the first or second vertical web element; however, this is not required. In one non-limiting configuration, the first vertical portion of the base track element can be configured to include one or more holes and/or apertures for the purpose of receiving one or more fasteners (e.g., screws, nails, bolts, pins, clips, etc.); however, this is not required. The one or more holes and/or apertures are not limited in size and/or shape. The one or more holes and/or apertures can be configured to facilitate one or more fasteners as the one or more fasteners are secured through the first vertical side portion of the base track element. In one non-limiting configuration, the one or more holes and/or apertures are provided at or near the center of the first vertical portion; however, this is not required.

In another and/or alternative non-limiting aspect of the present invention, the second vertical portion of the base track element can be formed in a generally planar, rectangular shape, and can be configured to be positioned parallel to the first vertical portion. In another and/or alternative non-limiting configuration, an end and/or surface of the second vertical portion can include a connection arrangement provided thereon for the purpose of at least partially connecting a portion of the base track element to the first or second vertical web element; however, this is not required. In one non-limiting configuration the size of the second vertical portion is about equal to the size of the first vertical portion; however, this is not required. In one non-limiting configuration, the second vertical portion of the base track element can be configured to include one or more holes and/or apertures for the purpose of receiving one or more fasteners (e.g., screws, nails, bolts, pins, clips, etc.); however, this is not required. The one or more holes and/or apertures are not limited in size and/or shape. The one or more holes and/or apertures can be configured to facilitate one or more fasteners as said one or more fasteners are secured through the second vertical side portion of the base track element. In one non-limiting configuration, the one or more holes and/or apertures are provided at or near the center of the second vertical portion; however, this is not required.

In another and/or alternative non-limiting aspect of the present invention, the horizontal portion of the base track element can be formed in a generally planar, rectangular shape, and can be configured to be positioned parallel to the building structural component; however, this is not required. The horizontal portion can be connected approximately perpendicularly at a first end to an end of the first vertical portion. Similarly, the horizontal portion can be connected approximately perpendicularly at a second end to the second vertical portion, said second end being opposite the end where the first vertical portion and the horizontal portion meet, thereby providing a generally U-shaped and/or C-shaped base track element; however, this is not required. The base track element is configured to be connected to an existing roof or building structure. The base track portion can include one or more holes or apertures to receive a connection member (e.g., nail, screw, bolt, rivet, staple, etc.) so that the base track element can be connected to the existing roof or building structure. As can be appreciated, the base track portion can be partially or fully connected to the existing roof or building structure by use of an adhesive.

The base track element is not limited in size. In one non-limiting configuration, the height of the base track element can be from about 2 inches to about 30 inches, more typically from about 3 inches to about 20 inches, and more typically from about 4 inches to about 12 inches. In another and/or alternative non-limiting configuration, the width of the top shaped element can be from about 1 inch to about 30 inches, more typically from about 2 inches to about 24 inches, and more typically from about 3 inches to about 20 inches. In still another and/or alternative non-limiting configuration, the length of the top shaped element can be from about 6 inches to about 84 inches, more typically from about 8 inches to about 72 inches, and more typically from about 12 inches to about 60 inches. In still yet another and/or alternative non-limiting configuration, the thickness of the material used to form the base track element can be from about 0.01 inches to about 2 inches, more typically from about 0.05 inches to about 1.5 inches, and more typically from about 0.10 inches to about 1 inch; however, this is not required.

The dimensions of each element of the retrofit framing system may be varied depending on a specific project and/or application requirements. One non-limiting aspect of the present invention is directed to an arrangement that has pre-engineered framing assemblies in accordance with the present invention, said pre-engineered framing assemblies having different gauges and/or lengths configured for various loads and pressures. The job-specific design can dictate which framing assembly will be required and where. One or more components of the retrofit framing assembly may be formed into the profile described above by cold-forming metal sheets using folding, press brake, roll forming, and/or other means. The punching and or lancing of one or more components of the retrofit framing assembly (when used) can be accomplished by mechanical dies, drills, laser cutting, water jet, plasma cutting, and/or other means. The retrofit framing assembly can be installed in a grid-like matrix based on job-specific structural analysis; however, this is not required.

In accordance with one non-limiting aspect of the present invention, at least a majority of the framing assembly is composed of a number of cold-formed light-gauge shaped metal components; however, the one or more components can be formed of other or additional materials. Generally, the size of the framing system is non-limiting.

In another and/or alternative non-limiting aspect of the present invention, there is provided a method of constructing a new roofing structure over an existing roofing structure of a building comprising: providing at least one roof framing assembly in accordance with the present invention, wherein the at least one roof framing assembly has a vertically adjustable height and has a free pitch rotation; positioning a bottom portion of the at least one roof framing assembly on the existing roofing structure of the building; securing the at least one roof framing assembly to the existing roofing structure of the building; vertically adjusting the height of the at least one roof framing assembly to accommodate the desired height of the new roofing structure; rotationally adjusting the pitch and/or slope of the at least one roof framing assembly to accommodate the desired pitch of the new roofing structure; sufficiently securing the at least one roof framing assembly in the desired vertical and/or rotational position; positioning the new roofing structure over the at least one roof framing assembly; and securing the new roofing structure to the at least one roof framing assembly.

It is accordingly one non-limiting object of the present invention to provide a framing assembly that adequately supports metal roofing and/or any sloped roofing in retrofit or new construction Another and/or alternative non-limiting object of the present invention is the provision of a framing assembly allowing the roof system to be supported over an existing flat roof.

Another and/or alternative non-limiting object of the present invention is the provision of a framing assembly that can be installed on site with minimal adjustment required for vertical and angled slope requirements of the roof.

Another and/or alternative non-limiting object of the present invention is the provision of a framing assembly composed of slotted holes to allow for field adjustments.

Another and/or alternative non-limiting object of the present invention is the provision of a framing assembly that incorporates preformed holes and slots in one or more of portions of the assembly to facilitate in the installation of the assembly.

Another and/or alternative non-limiting object of the present invention is the provision of a framing assembly that simplifies retrofit framing installation by having pre-engineered assemblies installed and adjusted in the field.

Another and/or alternative non-limiting object of the present invention is the provision of a framing assembly that allows for field adjustment of height and rotation of components without requiring any field modifications.

These and other objects and advantages will become apparent from the discussion of the distinction between the invention and the prior art and when considering the preferred embodiment shown in the accompanying drawings.

BRIEF DESCRIPTION OF THE DRAWINGS

Reference may now be made to the drawings, which illustrate various embodiments that the invention may take in physical form and in certain parts and arrangement of parts wherein.

DETAILED DESCRIPTION OF A NON-LIMITING EMBODIMENTS

Figure 1:
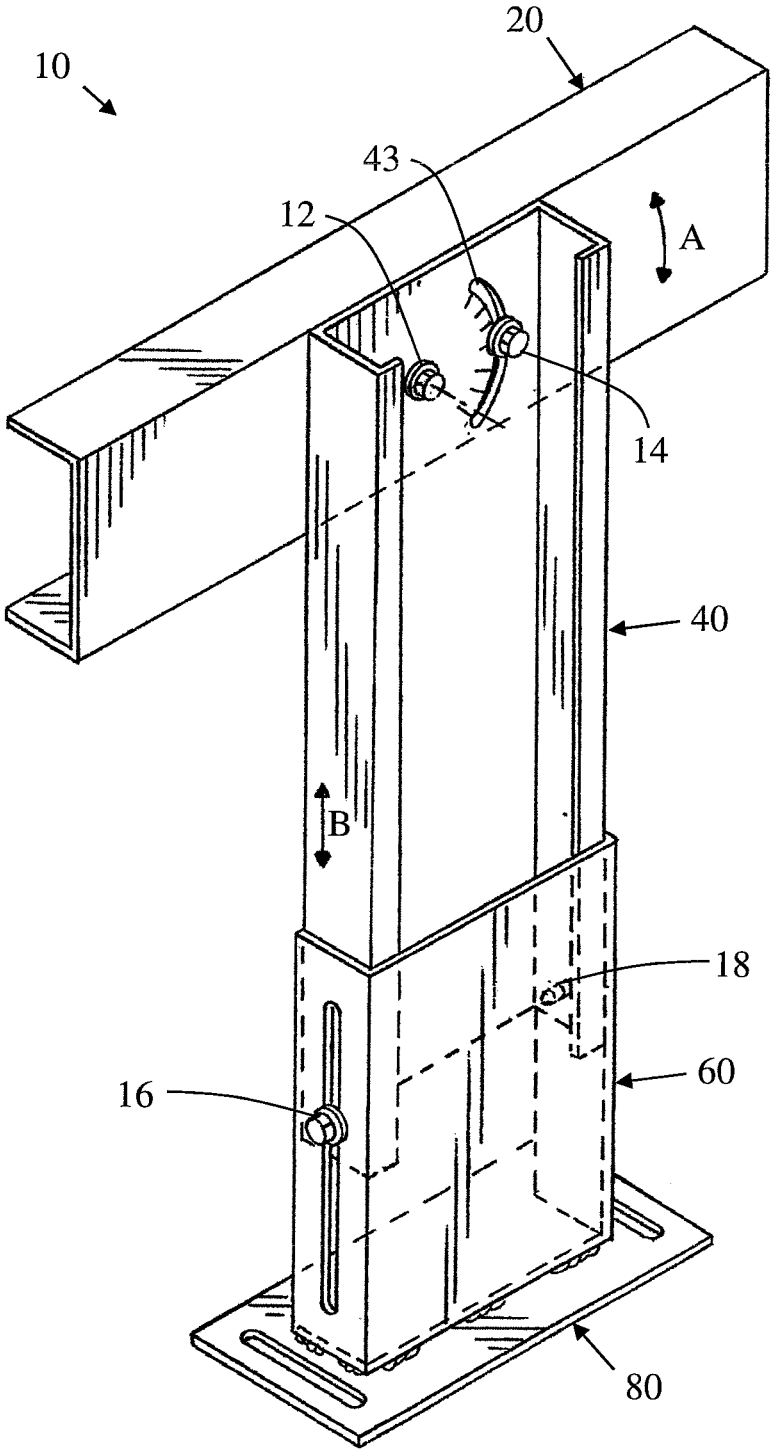
FIG. 1 is a perspective illustration of a framing system in accordance with one non-limiting aspect of the present invention.

Referring now to the drawings, wherein the showings are for the purpose of illustrating non-limiting embodiments of the invention only and not for the purpose of limiting the invention, FIGS. 1-4 illustrate various non-limiting framing assemblies in accordance with the present invention.

Figure 2:
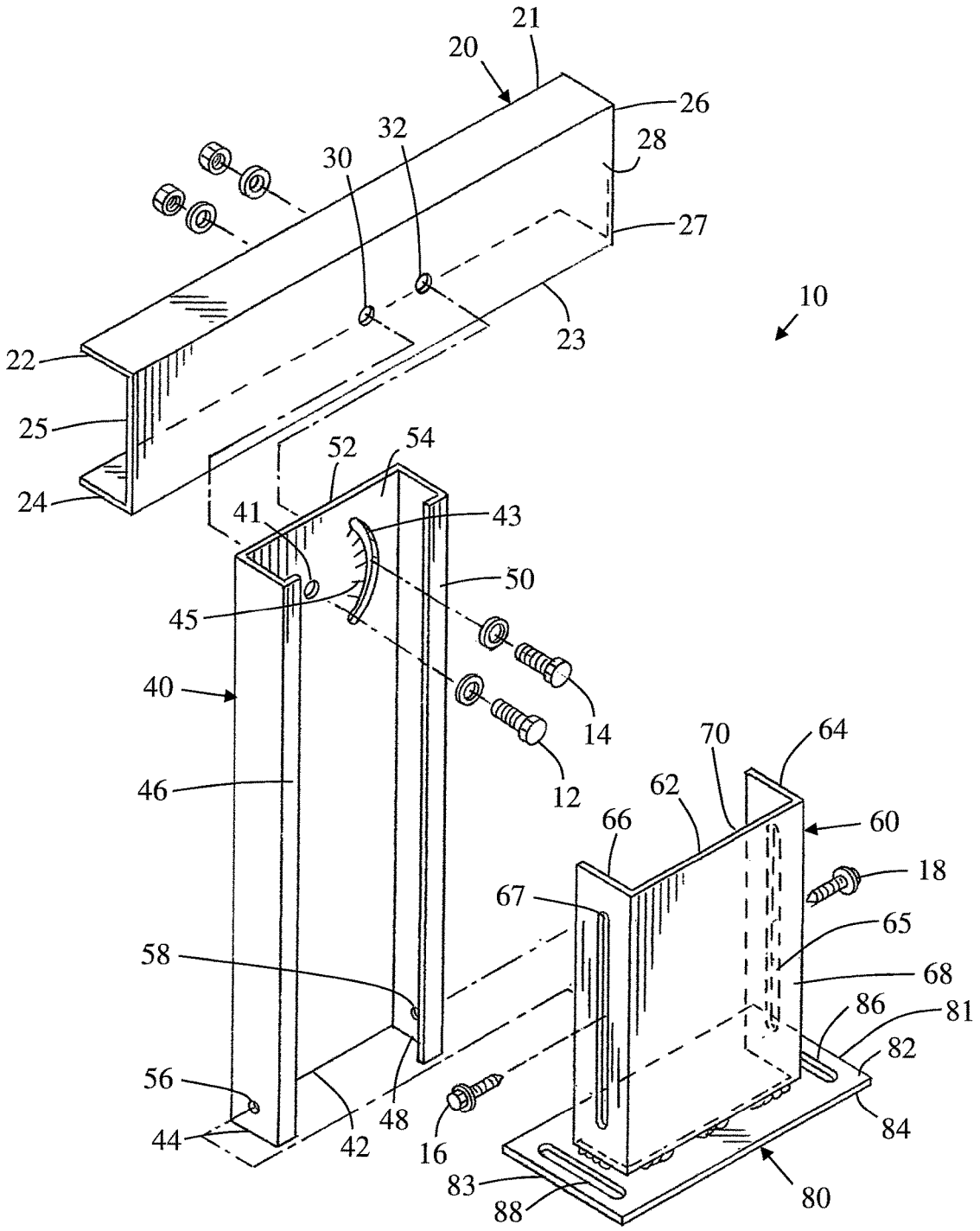
FIG. 2 is an exploded-view of the framing system of FIG. 1.

Referring now to FIG. 1, there is illustrated a framing assembly 10 in accordance with one non-limiting embodiment of the present invention. The framing assembly 10 is illustrated as having a top shaped element 20, a first vertical web element 40, an optional second vertical web element 60, and a base plate element 80. As illustrated in FIG. 1, second vertical web element 60 extends upwardly from base plate element 80, first vertical web element 40 is connected to and extends upwardly from second vertical web element 60, and top shaped element 20 is connected approximately perpendicularly (e.g., about 85-95°) to an upper portion of first vertical web element 40; however, other or alternative arrangements can be used. In such a configuration, the framing assembly 10 can be generally T-shaped or I-shaped; however, this is not required. As can be appreciated, the second vertical web element can be optionally eliminated and the first vertical web elements is connected to the base plate element. FIG. 2 is an exploded-view perspective illustration of the framing assembly of FIG. 1.

Figure 3:
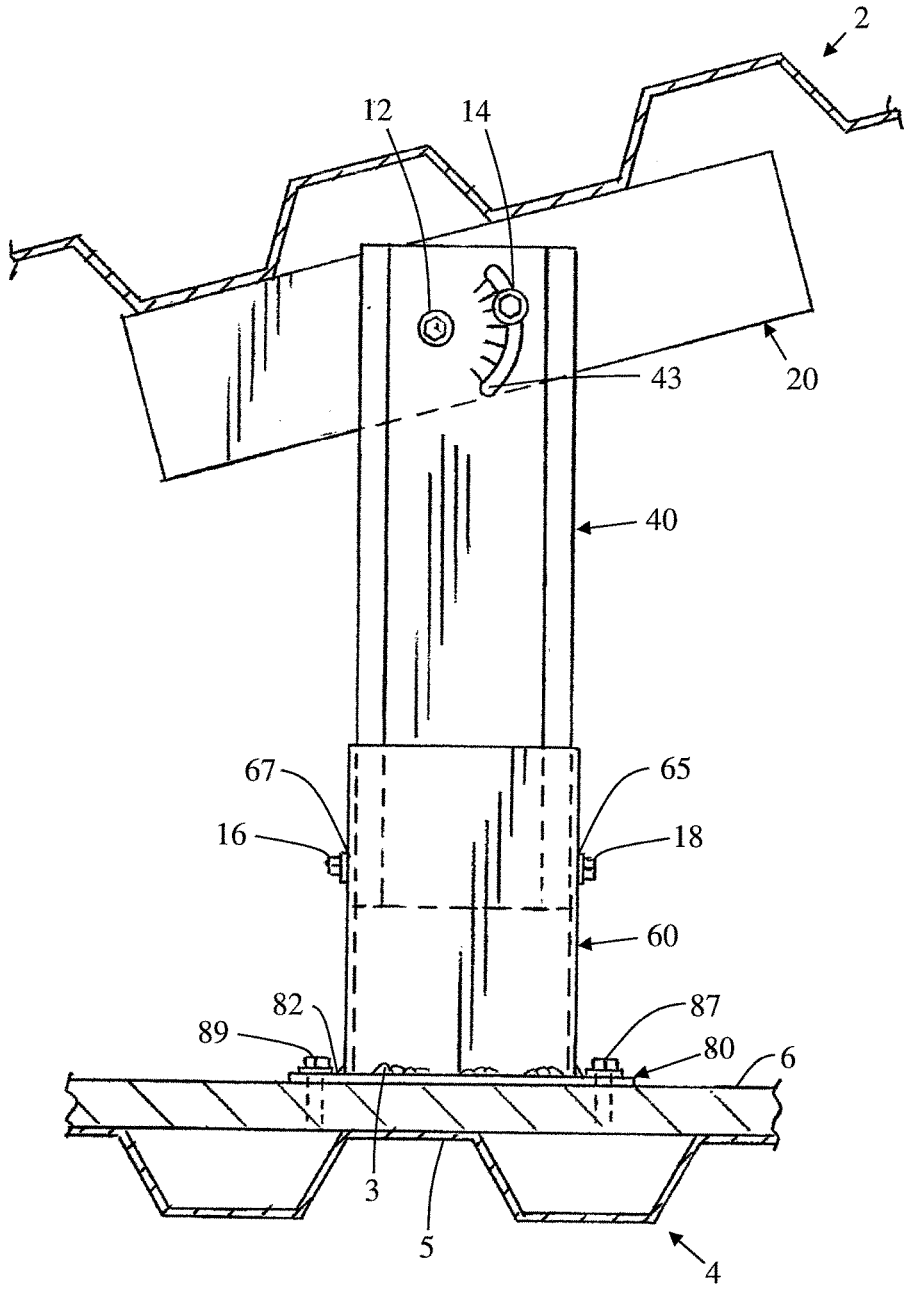
FIG. 3 is a side-view perspective illustration of the framing system of FIG. 1 wherein the framing assembly is connected to an existing roof and to a new roof; and, FIG. 4 is a perspective illustration of a framing system in accordance with another and/or alternative non-limiting aspect of the present invention.

Top shaped element 20 is illustrated in FIGS. 1-3 as being provided at or near the top portion (i.e., the end away from ground-level or existing roof) of framing assembly 10. Generally, top shaped element 20 is configured to connect to a portion of an overlaying roofing system as illustrated in FIG. 3 for the purpose of providing sub-structural support thereto. As illustrated in FIGS. 1-3, top shaped element 20 has a vertical portion 26, a first horizontal portion 22, and a second horizontal portion 24. First horizontal portion 22 is illustrated as extending approximately perpendicularly and outwardly from edge 21 of vertical portion 26. Second horizontal portion 24 is illustrated as extending approximately perpendicularly and outwardly from edge 23 of vertical portion 26 opposite edge 21 where first vertical portion 22 and vertical body portion 26 of top shaped element 20 meet. As such, top shaped element 20 is illustrated in FIG. 2 as being generally U-shaped, C-shaped, or [-shaped; however, this is not required. Vertical portion 26 is illustrated as being generally planar and rectangular in shape providing a front surface 28 and a rear surface 29. Front surface 28 of vertical portion 26 is illustrated as providing a mounting surface such that first vertical web element 40 can be connected thereto. Vertical portion 26 is also illustrated as including a hole and/or aperture 30 configured to receive at least a portion of a fastener 12 for the purpose of at least partially securing first vertical web element 40 thereto. Vertical portion 26 is also illustrated as including hole and/or aperture 32 configured to receive at least a portion of a fastener 14. Hole and/or aperture 32 is typically spaced apart from hole and/or aperture 30. As illustrated in FIG. 2, hole and/or aperture 30 is positioned a distance from edge 25 of top shaped element 20 at about an equal distance as hole and/or aperture 32 is positioned from edge 27 of top shaped element 20, thereby providing symmetry across top shaped element 20; however, this is not required. Holes and/or apertures 30, 32 are typically configured to facilitate in receiving fasteners 12, 14, respectively, as top shaped element 20 is releasably secured to first vertical web element 40.

First vertical web element 40 is illustrated as having a vertical main portion 42, a first vertical side portion 44, and a second vertical side portion 48. Vertical main portion 42 is illustrated as being generally planar and rectangular in shape providing a front surface 54 and a rear surface 52. First vertical side portion 44 is illustrated as being connected approximately perpendicularly (e.g., about 80-100° and all values and ranges therebetween) at a first end of vertical main portion 42. Second vertical side portion 48 is illustrated as being connected approximately perpendicularly (e.g., about 80-100° and all values and ranges therebetween) at an end of vertical main portion 42 opposite where first vertical side portion 44 and vertical main portion 42 of first vertical web element 40 meet. The end of first vertical side portion 44 opposite where first vertical side portion 44 and the vertical main portion 42 meet is illustrated as having a flange 46 extending approximately perpendicular and outwardly therefrom. Flange 46 is illustrated as being generally rectangular and planar in shape. Similarly, the end of second vertical side portion 48 opposite where second vertical side portion 48 and vertical main portion 42 meet is illustrated as having a flange 50 extending approximately perpendicularly and outwardly therefrom. Flange 50 is illustrated as being generally rectangular and planar in shape. In operation, flanges 46, 50 can be configured to 1) at least partially frictionally engage with a portion of the second vertical web element 60, and/or 2) provide structural support to framing assembly 10 by improving the strength and rigidity properties of first vertical web element 40; however, this is not required.

With continued reference to FIGS. 1-3, first vertical side portion 44 is illustrated as having a hole and/or aperture 56 provided at or near a lower end thereof. Hole and/or aperture 56 is generally configured to receive at least a portion of a fastener 16 for the purpose of at least partially releasably securing first vertical web element 40 to second vertical web element 60. Similarly, second vertical side portion 48 is illustrated as having a hole and/or aperture 58 provided at or near a lower end thereof. Hole and/or aperture 58 is generally configures to receive at least a portion of a fastener 18 for the purpose of at least partially releasably securing the first vertical web element 40 to the second vertical web element 60. As such, first vertical web element 40 can be releasably secured to second vertical web element 60 by at least 1) fastener 16 inserted throughhole and/or aperture 56, and/or 2) fastener 18 inserted through hole and/or aperture 58.

Vertical body portion 42 of first vertical web element 40 is illustrated in FIGS. 1-3 as having a hole and/or aperture 41 configured to facilitate insertion of fastener 12 therethrough. Vertical body portion 42 of first vertical web element 40 is also illustrated as having a slot 43 provided at or near hole and/or aperture 41. Slot 43 is typically configured to facilitate in receiving fastener 14 therethrough, and is illustrated as having a generally arcuate and/or radial shape; however, this is not required.

Generally, hole and/or aperture 41 and slot 43 are configured to correspond with holes and/or apertures 30, 32, respectively. In operation, the front surface 28 of vertical portion 26 is configured to engage the substantially flat rear surface 52 of vertical body portion 42 such that hole and/or aperture 41 aligns with hole and/or aperture 30, and such that slot 43 aligns with hole and/or aperture 32. In such a configuration, fastener 12 can be inserted through hole and/or aperture 41 of first vertical web element 40 and subsequently through hole and/or aperture 30 of top shaped element 20. Similarly, fastener 14 can be inserted through slot 43 of first vertical web element 40 and subsequently through hole and/or aperture 32 of top shaped element 20. When fastener 12 is inserted through hole and/or aperture 41, fastener 12 can serve as a pivot point about which the top shaped element can rotate. A plurality of angle markers 45 are illustrated as being provided at or near slot 43 for the purpose of setting the top shaped element 20 at a specified angle relative to the first vertical web element 40. As illustrated in FIGS. 1-2, angle markers 45 can be lines provided on the front surface 54 of vertical body portion 42; however, the markers can be other forms (e.g., printed markers, laminated markers, etc.).

Second vertical web element 60 is illustrated as having a vertical main portion 62, a first vertical side portion 64, and a second vertical side portion 66. The vertical main portion 62 is illustrated as being generally planar and rectangular in shape providing a front surface 68 and a rear surface 70. First vertical side portion 64 is illustrated as being connected approximately perpendicularly at a first end of vertical main portion 62. Second vertical side portion 66 is illustrated as being connected approximately perpendicularly to an end of vertical main portion 62 opposite where first vertical side portion 64 and vertical main portion 62 of second vertical web element 60 meet. As such, second vertical web element 60 is illustrated as being generally U-shaped, C-shaped, or [-shaped; however, other or alternative shapes can be used.

First vertical side portion 64 is illustrated as being generally planar and rectangular in shape, and as having a slot 65 therein. Slot 65 is illustrated as extending lengthwise from a bottom end (i.e., an end closer to ground-level) of first vertical side portion 64 to an upper end (i.e., an end away from ground-level) of first vertical side portion 64. Similarly, second vertical side portion 66 is illustrated as being generally planar and rectangular in shape, and as having a slot 67 therein. Slot 67 is illustrated as extending lengthwise from a bottom end (i.e., an end closer to ground-level) of first vertical side portion 64 to an upper end (i.e. an end away from ground-level) of first vertical side portion 64. Generally, slots 65, 67 are configured to facilitate movement of fasteners 16, 18, respectively, therethrough.

Base plate element 80 is illustrated as being substantially planar and as having a generally rectangular shape providing a top surface 82 and a bottom surface 84. As illustrated in FIGS. 1-2, base plate element 80 has a first slot 86 and a second slot 88. The first slot 86 is illustrated as being provided at or near a first edge 81 of base plate element 80. Second slot 88 is illustrated as being provided at or near a second edge 83 of base plate element 80. As further illustrated in FIG. 2, the second vertical web element 60 can be connected to the top surface 82 of base plate element 80 (e.g., weld bead, rivet, melted seam, bolt, screw, etc.). The second vertical web element 60 and the base plate element 80 are illustrated as being formed as separate components; however, this is not required. As can be appreciated, the base plate element 80 and the second vertical web element 60 can be integrally formed in a one-piece construction.

With reference to FIGS. 1-3, framing assembly 10 includes multiple components movable relative to each other. As illustrated in FIGS. 1-3, top shaped element 20 and first vertical web element 40 are at least partially connected together by fastener 12, and at least partially connected together by fastener 14. As such, fastener 12 can be configured to provide a pivot point about which top shaped element 20 can be rotated relative to first vertical web element 40 as illustrated by arrow A in FIG. 1. Similarly, first vertical web element 40 and second vertical web element 60 are at least partially connected together by fastener 16, and at least partially connected together by fastener 18. As such, vertical web element 40 is capable of moving vertically relative to second vertical web element 60. While fasteners 16, 18 remain in a constant position in holes and/or apertures 56, 58, respectively, fasteners 16, 18 are free to move in an upward and/or downward direction in slots 65, 67, respectively, of second vertical web element 60. As such, the top portion of framing assembly 10 (i.e., top shaped member 20 and first vertical portion 40) can be moved vertically relative to the bottom portion (i.e., second vertical web element 60 and base plate element 80) of framing assembly 10, as illustrated by arrow B in FIG. 1. Thus, framing assembly 10 can provide 1) a vertically adjustable height, and/or 2) a free pitch rotation for the purpose of accommodating the use of framing assembly 10 in various roofing systems.

FIG. 3 is a side-view perspective illustration of the framing assembly 10 of FIGS. 1-2. Like numbers used in FIGS. 1-2 correspond to like features of the embodiment shown in FIG. 3.

As illustrated in FIG. 3, framing assembly 10 is capable of providing support for a new roofing system 2 over the existing roofing system 4 of a building (not shown). The existing roofing system 4 can include one or more components, such as, for example, a metal component 5 and an upper layer 6; however, the framing assembly of the present invention can be used in conjunction with existing roof systems having other or additional components. In operation, second vertical web element 60 can typically be connected to base plate element 80 prior to installation; however, this is not required. The connection means is non-limiting. In the non-limiting illustration of FIG. 3, a welding 3 can be used to connect second vertical web element 60 to the top surface 82 of base plate element 80; however, this is not required. As illustrated in FIG. 3, fasteners 87, 89 can be inserted through holes and/or apertures 86, 88 of base plate element 80, thereby releasably securing the base plate element 80 to the existing roofing system 4. First vertical web element 40 can then be inserted between first vertical side portion 64 and second vertical side portion 66 of second vertical web element 80. Fastener 16 can then be inserted through slot 67 of second vertical web element 60, and further through hole and/or aperture 56 of first vertical web element 60. Similarly, fastener 18 can be inserted through slot 65 of second vertical web element 60, and further through hole and/or aperture 58 of first vertical web element 40. As such, first vertical web element 40 is free to slide upwardly and downwardly via slots 65, 67 of second vertical web element so as to provide a vertically adjustable height of framing assembly 10. Once fasteners 16, 18 have been sufficiently tightened, movement of the first vertical web element 40 can be ceased, so as to provide a fixed vertical height of framing assembly 10. Top shaped element 20 can be attached to first vertical web element 40. Fastener 12 can be inserted through hole and/or aperture 41 of first vertical web element 40, and further through hole and/or aperture 30 of top shaped element 20. Similarly, fastener 14 can be inserted through slot 43 of first vertical web element 40, and further through hole and/or aperture 32 of top shaped element 20. In such a configuration, top shaped element 20 can be freely rotated relative to first vertical web element 40 about fastener 12. Once fasteners 12, 14 have been sufficiently tightened, rotational movement of top shaped element 20 is ceased, so as to provide a fixed angle and/or slope of framing assembly 10.

Figure 4:
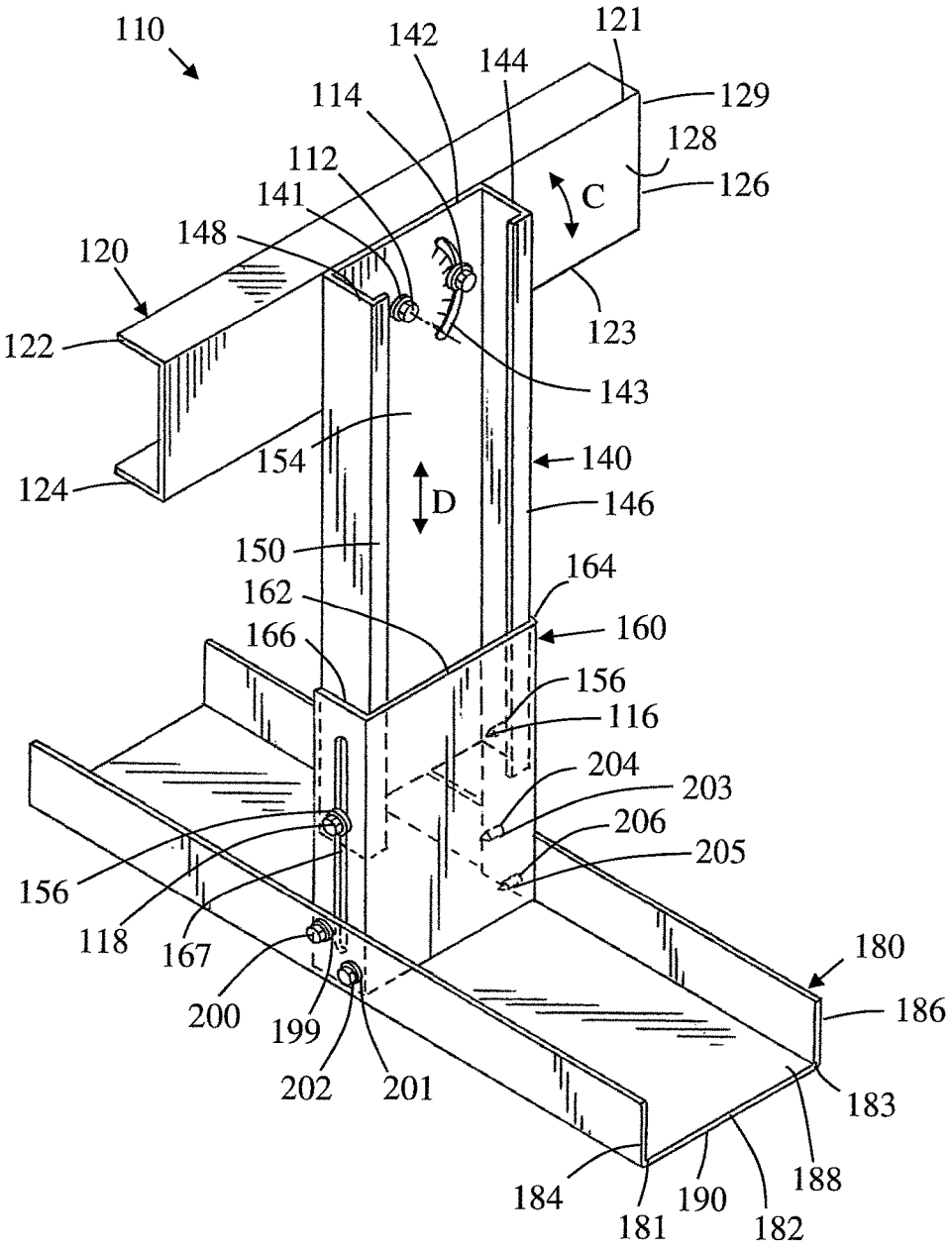

Referring now to FIG. 4, there is illustrated a framing assembly 110 in accordance with another and/or alternative non-limiting embodiment of the present invention. The framing assembly 110 is similar to framing assembly 10 and many of the parts and functions and advantages are the same, thus many of the details will not be repeated herein.

The framing assembly 110 is illustrated as having a top shaped element 120, a first vertical web element 140, a second vertical web element 160, and a base element 180. Generally, the top shaped element 120 of FIG. 4 can be the same in structure and function as top shaped element 20 of FIG. 1, first vertical web element 140 of FIG. 4 can be the same in structure and function as first vertical web element 40 of FIG. 1, and second vertical web element 160 of FIG. 4 can be the same in structure and function as second vertical web element 60 of FIG. 1; however, this is not required. As illustrated in FIG. 4, second vertical web element 160 is connected to and extends upwardly from base track element 180, first vertical web element 140 is connected to and extends upwardly from second vertical web element 160, and top shaped element 120 is connected approximately perpendicularly (e.g., about 80-100°) to an upper portion of first vertical web element 140; however, other or alternative arrangements can be used. In such a configuration, the framing assembly 110 can be generally T-shaped or I-shaped; however, this is not required. Framing assembly 110 can be configured to 1) have a vertically adjustable height, 2) have a free pitch rotation, and/or 3) support exterior building roofing materials over an existing roof.

Top shaped element 120 is illustrated in FIG. 4 as being provided at or near the top portion (i.e., the end away from ground-level) of framing assembly 110. Generally, top shaped element 120 is configured to connect to a portion of an overlaying roofing system (similar to that illustrated in FIG. 3) for the purpose of providing sub-structural support thereto. As illustrated in FIG. 4, top shaped element 120 has a vertical portion 126, a first horizontal portion 122, and a second horizontal portion 124. First horizontal portion 122 is illustrated as extending approximately perpendicularly and outwardly from edge 121 of vertical portion 126. Second horizontal portion 124 is illustrated as extending approximately perpendicularly and outwardly from edge 123 of vertical portion 126 opposite edge 121 where first vertical portion 122 and vertical body portion 126 of top shaped element 120 meet. As such, top shaped element 120 is illustrated in FIG. 4 as being generally U-shaped, C-shaped, or [-shaped; however, this is not required. Vertical portion 126 is illustrated as being generally planar and rectangular in shape providing at least a front surface 128. Front surface 128 of vertical portion 126 is illustrated as having a substantially flat surface, thereby providing a mounting surface such that first vertical web element 140 can be connected thereto. Vertical portion 126 can include at least one hole and/or aperture configured to receive at least a portion of fasteners 112, 114 for the purpose of at least partially securing first vertical web element 140 thereto.

First vertical web element 140 is illustrated as having a vertical main portion 142, a first vertical side portion 144, and a second vertical side portion 148. Vertical main portion 142 is illustrated as being generally planar and rectangular in shape providing at least a front surface 154. First vertical side portion 144 is illustrated as being connected approximately perpendicularly (e.g., about 80-100°) and as extending outwardly from a first end of vertical main portion 142. Second vertical side portion 148 is illustrated as being connected approximately perpendicularly (e.g., about 80°-100°) and extending outwardly from an end of vertical main portion 142 opposite where first vertical side portion 144 and vertical main portion 142 of first vertical web element 140 meet. The end of first vertical side portion 144 opposite where first vertical side portion 144 and the vertical main portion 142 meet is illustrated as having a flange 146 extending approximately perpendicular and outwardly therefrom. Flange 146 is illustrated as being generally rectangular and planar in shape. Similarly, the end of second vertical side portion 148 opposite where second vertical side portion 148 and vertical main portion 142 meet is illustrated as having a flange 150 extending approximately perpendicularly and outwardly therefrom. Flange 150 is illustrated as being generally rectangular and planar in shape. In operation, flanges 146, 150 can be configured to 1) at least partially frictionally engage with a portion of the second vertical web element 160, and/or 2) provide structural support to framing assembly 110 by improving the strength and rigidity properties of first vertical web element 40; however, this is not required.

With continued reference to FIG. 4, first vertical side portion 144 is illustrated as having a hole and/or aperture 156 provided at or near a lower end thereof and configured to receive at least a portion of a fastener 116 for the purpose of at least partially releasably securing first vertical web element 140 to second vertical web element 160. Similarly, second vertical side portion 148 can have a second hole and/or aperture 156 provided at or near a lower end thereof and configured to receive at least a portion of a fastener 118 for the purpose of at least partially releasably securing the first vertical web element 140 to the second vertical web element 160. As such, first vertical web element 140 can be releasably secured to second vertical web element 160 by at least 1) fastener 116 inserted through hole and/or aperture 156, and/or 2) fastener 118 inserted through the second hole and/or aperture 156.

Vertical body portion 142 of first vertical web element 140 is illustrated in FIG. 4 as having a hole and/or aperture 141 configured to facilitate insertion of fastener 112 therethrough. Vertical body portion 142 of first vertical web element 140 is also illustrated as having a slot 143 provided at or near hole and/or aperture 141. Slot 143 is typically configured to facilitate fastener 114 therethrough, and is illustrated as having a generally arcuate and/or radial shape; however, this is not required. Slot 143 is illustrated as having an arcuate and/or radial shape relative to hole and/or aperture 141.

Second vertical web element 160 is illustrated as having a vertical main portion 162, a first vertical side portion 164, and a second vertical side portion 166. The vertical main portion 162 is illustrated as being generally planar and rectangular in shape providing at least a front surface 168. First vertical side portion 164 is illustrated as being connected approximately perpendicularly and extending outwardly from a first end of vertical main portion 162. Second vertical side portion 166 is illustrated as being connected approximately perpendicularly and extending outwardly from an end of vertical main portion 162 opposite where first vertical side portion 164 and vertical main portion 162 of second vertical web element 160 meet. As such, second vertical web element 160 is illustrated as being generally U-shaped or [-shaped; however, other or alternative shapes can be used.

First vertical side portion 164 is illustrated as being generally planar and rectangular in shape, and as having a slot therein. The slot of first vertical web element 164 is illustrated as extending lengthwise from a bottom end (i.e., an end closer to ground-level) of first vertical side portion 164 to an upper end (i.e., an end away from ground-level) of first vertical side portion 164. Similarly, second vertical side portion 166 is illustrated as being generally planar and rectangular in shape, and as having a slot 167 therein. Slot 167 is illustrated as extending lengthwise from a bottom end (i.e., an end closer to ground-level) of first vertical side portion 164 to an upper end (i.e., an end away from ground-level) of first vertical side portion 164.

Base element 180 is illustrated in FIG. 4 as being provided at or near the bottom portion (i.e., the end closest to ground-level) of framing assembly 110. Generally, base element 180 is configured to connect to a portion of an underlying, existing roofing system (not shown). As illustrated in FIG. 4, base element 180 has a base portion 182, a first vertical portion 184, and a second vertical portion 186. First vertical portion 184 is illustrated as extending approximately perpendicularly and outwardly from edge 181 of base portion 182. Second vertical portion 186 is illustrated as extending approximately perpendicularly and outwardly from edge 183 of base portion 182 opposite edge 181 where first vertical portion 184 and base portion 182 meet. As such, base element 180 is illustrated in FIG. 4 as being generally U-shaped, C-shaped, or [-shaped; however, this is not required. Base portion 182 is illustrated as being generally planar and rectangular in shape and as providing a top surface 188 and a bottom surface 182. As further illustrated in FIG. 4, the second vertical web element 160 is connected to the top surface 188 of base element 180. The bottom surface 190 of base element 180 can be connected to an existing roof component. Base element 180 can include a plurality of holes and/or apertures 199, 201, 203, 205 for the purpose of facilitating insertion of fasteners 200, 202, 204, 206, respectively, therethrough.

Framing assembly 110 is illustrated in FIG. 4 as including multiple components movable relative to each other. As illustrated in FIG. 4, top shaped element 120 and first vertical web element 140 are at least partially connected together by fastener 112, and at least partially connected together by fastener 114. As such, fastener 112 can be configured to provide a pivot point about which top shaped element 120 can be rotated relative to first vertical web element 140 as illustrated by arrow C in FIG. 4. Similarly, first vertical web element 140 and second vertical web element 160 are at least partially connected together by fastener 116, and at least partially connected together by fastener 118. As such, vertical web element 140 is capable of moving relative to second vertical web element 160. While fasteners 116, 118 remain in a constant position relative to first vertical web element 140, fasteners 116, 118 are free to move in an upward and/or downward direction relative to second vertical web element 160. As such, the top portion of framing assembly 110 (i.e., top shaped member 120 and first vertical portion 140) can be moved vertically relative to the bottom portion (i.e., second vertical web element 160 and base track element 180) of framing assembly 110, as illustrated by arrow D in FIG. 4. Thus, framing assembly 110 can provide 1) a vertically adjustable height, and/or 2) a free pitch rotation for the purpose of accommodating the use of framing assembly 10 in various roofing systems.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

What is claimed:

1. A method of constructing a new roofing structure over an existing roofing structure of a building, the method comprising:

providing at least one roof framing assembly having a vertically adjustable height and having a free pitch rotation, said at least one roof framing assembly further comprises:

a top-shaped element having at least one flat surface and designed to provide a mounting surface for the exterior building roofing materials, said top-shaped element oriented in the horizontal plane, said top-shaped element further comprises:

a vertical portion capable of providing a mounting surface for attachment to the first vertical web portion;

a first horizontal portion extending outwardly from an end of the vertical portion;

a second horizontal portion extending outwardly from an end of the vertical portion opposite where the first horizontal portion and the vertical portion of the top-shaped element meet; and, at least one preformed hole for alignment and/or ease of installing fasteners;

a first vertical web element having at least one flat surface and designed to connect to said top-shaped element, said first vertical web element oriented in the vertical plane;

a second vertical web element having at least one flat surface and designed to connect to said first vertical web element, said second vertical web element oriented in the vertical plane; and, a base element having at least one flat surface and designed to connect to the second vertical web element, and further designed to connect to the existing roofing structure of the building, said base element capable of providing an adjustable attachment to a building structural component, said base element oriented in the horizontal plane;

positioning a bottom portion of the at least one roof framing assembly on the existing roofing structure of the building;

securing the at least one roof framing assembly to the existing roofing structure of the building;

vertically adjusting the height of the at least one roof framing assembly to accommodate the desired height of the new roofing structure;

rotationally adjusting the pitch and/or slope of the at least one roof framing assembly to accommodate the desired pitch of the new roofing structure;

sufficiently securing the at least one roof framing assembly in position;

positioning the new roofing structure over the at least one roof framing assembly; and, securing the new roofing structure to the at least one roof framing assembly.

2. The method as defined in claim 1, wherein the top shaped element is further designed to be rotatable in the field so as to fit a desired roof slope.

3. A method of constructing a new roofing structure over an existing roofing structure of a building, the method comprising:

providing at least one roof framing assembly having a vertically adjustable height and having a free pitch rotation, said at least one roof framing assembly further comprises:

a top-shaped element having at least one flat surface and designed to provide a mounting surface for the exterior building roofing materials, said top-shaped element oriented in the horizontal plane;

a first vertical web element having at least one flat surface and designed to connect to said top-shaped element, said first vertical web element oriented in the vertical plane, the first vertical web element further comprises:

a vertical body portion capable of releasably securing attachment of the top shaped element;

a first vertical portion extending outwardly from an end of the vertical body portion;

a second vertical portion extending outwardly from an end of the vertical body portion opposite where the first vertical portion and the vertical body portion of the first vertical web element meet;

at least one preformed hole for alignment and/or ease of installing fasteners; and, a calibrated radial slot capable of guiding the rotation of the top shaped element;

a second vertical web element having at least one flat surface and designed to connect to said first vertical web element, said second vertical web element oriented in the vertical plane; and, a base element having at least one flat surface and designed to connect to the second vertical web element, and further designed to connect to the existing roofing structure of the building, said base element capable of providing an adjustable attachment to a building structural component, said base element oriented in the horizontal plane;

positioning a bottom portion of the at least one roof framing assembly on the existing roofing structure of the building;

securing the at least one roof framing assembly to the existing roofing structure of the building;

vertically adjusting the height of the at least one roof framing assembly to accommodate the desired height of the new roofing structure;

rotationally adjusting the pitch and/or slope of the at least one roof framing assembly to accommodate the desired pitch of the new roofing structure;

sufficiently securing the at least one roof framing assembly in position;

positioning the new roofing structure over the at least one roof framing assembly; and, securing the new roofing structure to the at least one roof framing assembly.

4. A method of constructing a new roofing structure over an existing roofing structure of a building, the method comprising:

providing at least one roof framing assembly having a vertically adjustable height and having a free pitch rotation, said at least one roof framing assembly further comprises:

a top-shaped element having at least one flat surface and designed to provide a mounting surface for the exterior building roofing materials, said top-shaped element oriented in the horizontal plane;

a first vertical web element having at least one flat surface and designed to connect to said top-shaped element, said first vertical web element oriented in the vertical plane;

a second vertical web element having at least one flat surface and designed to connect to said first vertical web element, said second vertical web element oriented in the vertical plane, the second vertical web element further comprises:

a vertical body portion capable of facilitating attachment of the first vertical web element thereto;

a first vertical portion extending outwardly from an end of the vertical body portion;

a second vertical portion extending outwardly from an end of the vertical body portion opposite where the first vertical portion and the vertical body portion of the second vertical web element meet; and, at least one slot capable of providing a means for height adjustment of the roof framing assembly; and, a base element having at least one flat surface and designed to connect to the second vertical web element, and further designed to connect to the existing roofing structure of the building, said base element capable of providing an adjustable attachment to a building structural component, said base element oriented in the horizontal plane;

positioning a bottom portion of the at least one roof framing assembly on the existing roofing structure of the building;

securing the at least one roof framing assembly to the existing roofing structure of the building;

vertically adjusting the height of the at least one roof framing assembly to accommodate the desired height of the new roofing structure;

rotationally adjusting the pitch and/or slope of the at least one roof framing assembly to accommodate the desired pitch of the new roofing structure;

sufficiently securing the at least one roof framing assembly in position;

positioning the new roofing structure over the at least one roof framing assembly; and, securing the new roofing structure to the at least one roof framing assembly.

5. The method as defined in claim 1, wherein at least a majority of the roof framing assembly is formed from an engineered light-gauge metal component.

6. A method of constructing a new roofing structure over an existing roofing structure of a building, the method comprising:

providing at least one roof framing assembly capable of providing sub-structural support for exterior roofing materials over an existing roofing structure of a building, the assembly comprising:

a top shaped element having a longitudinal element axis and an element portion and a first horizontal portion extending along said longitudinal axis, said element portion having a front and back side, said first horizontal portion extending outwardly from said front side of said element portion, said element portion including an element connection arrangement positioned between a first and second end of said element portion, said first horizontal portion configured to provide a mounting surface for the exterior building roofing materials;

a first vertical web element having a longitudinal axis and a first web portion extending along said longitudinal first web axis, said first web portion having a front and back side and including a web connection arrangement configured to releasably connect to said element connection arrangement of said element portion, said web connection arrangement and said element connection arrangement when releasably connected together configured to enable said top shape element to be connected to said first vertical web element and to enable said top shape element to rotate about a rotation axis that is normal to said first web axis such that said top shape element can be positioned at a plurality of angles relative to said first vertical web, said back side of said element portion faces front side of said first web portion and said longitudinal element axis and said longitudinal first web axis are nonparallel to one another when said top shaped element is releasably connected to said first vertical web element;

a second vertical web element having a second web portion extending along a longitudinal second web axis, said second vertical web element having a front and back side and including an adjustable connection arrangement to releasably connect to said first vertical web element and to enable said first vertical web to be secured to said second vertical web at different locations along a longitudinal length of said second vertical web, said longitudinal first web axis oriented parallel to said longitudinal second web axis when said first vertical web element is releasably connected to said second vertical web element; and, a base element having a base portion extending along a longitudinal base axis, said base portion connected to said second vertical web element such that said longitudinal base axis and said longitudinal second web axis are nonparallel to one another, said base element configured to connect to the existing roofing structure of the building;

securing the at least one roof framing assembly to the existing roofing structure of the building;

vertically adjusting the height of the at least one roof framing assembly to accommodate the desired height of the new roofing structure;

rotationally adjusting the pitch and/or slope of the at least one roof framing assembly to accommodate the desired pitch of the new roofing structure;

sufficiently securing the at least one roof framing assembly in position;

positioning the new roofing structure over the at least one roof framing assembly; and, securing the new roofing structure to the at least one roof framing assembly.

7. The method as defined in claim 6, wherein said web connection arrangement includes an arcuate shaped slot and a fastener portion located in said first web portion, said fastener portion spaced from said arcuate shaped slot, a central axis of said fastener portion is positioned along said rotation axis, said fastener portion configured to engage a first element connector, and said element connection arrangement including first and second connector portions, said first element connector configured to connect to said element portion to said first web portion to via said first connector portion and said fastener portion to enable said top shaped element to rotate about said rotation axis, said arcuate shaped slot configured to receive a second element connector, said second element connector configured to form a second connection between said element portion and said first web portion via said second connector portion and said arcuate shaped slot, a portion of said second connection configured to move in and along said arcuate shaped slot when said top shaped element is rotated about said rotation axis, said slot configured to prevent said top shaped element from rotating 360° about said rotation axis, said first and second element connectors configured to secure said top shaped element in a single position relative to said first vertical web element after said top shaped element has been rotated to a desired position about said rotation axis.

8. The method as defined in claim 7, wherein said fastener portion is a circular shaped opening, said first web portion including a plurality of angle markers positioned adjacent to said arcuate shaped slot.

9. The method as defined in claim 6, wherein the top shaped element includes a second horizontal portion, said second horizontal portion extending outwardly from said front side of said element portion, said first and second horizontal portions positioned parallel to one another, at least one of said first and second fastener portions is a circular shaped opening.

10. The method as defined in claim 7, wherein the top shaped element includes a second horizontal portion, said second horizontal portion extending outwardly from said front side of said element portion, said first and second horizontal portions positioned parallel to one another, at least one of said first and second fastener portions is a circular shaped opening.

11. The method as defined in claim 6, wherein said adjustable connection arrangement of said second vertical web element includes a first web slot having a longitudinal length that is parallel to said longitudinal second web axis, said first vertical web element including a second web connection arrangement, said second web connection arrangement and said first web slot configured to receive a first web fastener, said first web fastener configured to move along a length of said first web slot when said first vertical web element is positioned at different locations along a longitudinal length of said second vertical web, said first web fastener configured to secure said first vertical web element to a single position relative to said second vertical web when said first web fastener is in a fasten position.

12. The method as defined in claim 7, wherein said adjustable connection arrangement of said second vertical web element includes a first web slot having a longitudinal length that is parallel to said longitudinal second web axis, said first vertical web element including a second web connection arrangement, said second web connection arrangement and said first web slot configured to receive a first web fastener, said first web fastener configured to move along a length of said first web slot when said first vertical web element is positioned at different locations along a longitudinal length of said second vertical web, said first web fastener configured to secure said first vertical web element to a single position relative to said second vertical web when said first web fastener is in a fasten position.

13. The method as defined in claim 10, wherein said adjustable connection arrangement of said second vertical web element includes a first web slot having a longitudinal length that is parallel to said longitudinal second web axis, said first vertical web element including a second web connection arrangement, said second web connection arrangement and said first web slot configured to receive a first web fastener, said first web fastener configured to move along a length of said first web slot when said first vertical web element is positioned at different locations along a longitudinal length of said second vertical web, said first web fastener configured to secure said first vertical web element to a single position relative to said second vertical web when said first web fastener is in a fasten position.

14. The method as defined in claim 6, wherein said first vertical web element includes first and second flanges, said first vertical web element including first and second connector openings, said first and second flanges extending outwardly from a back side of said first web portion, said first connector opening positioned on said first flange, said second connector opening positioned on said second flange, said second vertical web element includes first and second flanges and first and second web slots, said first and second flanges extending outwardly from a front side of said second web portion, said first web slot positioned on said first flange, said second web slot positioned on said second flange, said first connector opening and said first web slot configured to receive a first web fastener, said first web fastener configured to move along a length of said first web slot when said first vertical web element is positioned at different locations along a longitudinal length of said second vertical web, said second connector opening and said second web slot configured to receive a second web fastener, said second web fastener configured to move along a length of said second web slot when said second vertical web element is positioned at different locations along a longitudinal length of said second vertical web, said first and second web fasteners configured to secure said first vertical web element to a single position relative to said second vertical web when said first and second web fasteners are in a fasten position.

15. The method as defined in claim 7, wherein said first vertical web element includes first and second flanges, said first vertical web element including first and second connector openings, said first and second flanges extending outwardly from a back side of said first web portion, said first connector opening positioned on said first flange, said second connector opening positioned on said second flange, said second vertical web element includes first and second flanges and first and second web slots, said first and second flanges extending outwardly from a front side of said second web portion, said first web slot positioned on said first flange, said second web slot positioned on said second flange, said first connector opening and said first web slot configured to receive a first web fastener, said first web fastener configured to move along a length of said first web slot when said first vertical web element is positioned at different locations along a longitudinal length of said second vertical web, said second connector opening and said second web slot configured to receive a second web fastener, said second web fastener configured to move along a length of said second web slot when said second vertical web element is positioned at different locations along a longitudinal length of said second vertical web, said first and second web fasteners configured to secure said first vertical web element to a single position relative to said second vertical web when said first and second web fasteners are in a fasten position.

16. The method as defined in claim 13, wherein said first vertical web element includes first and second flanges, said first vertical web element including first and second connector openings, said first and second flanges extending outwardly from a back side of said first web portion, said first connector opening positioned on said first flange, said second connector opening positioned on said second flange, said second vertical web element includes first and second flanges and first and second web slots, said first and second flanges extending outwardly from a front side of said second web portion, said first web slot positioned on said first flange, said second web slot positioned on said second flange, said first connector opening and said first web slot configured to receive a first web fastener, said first web fastener configured to move along a length of said first web slot when said first vertical web element is positioned at different locations along a longitudinal length of said second vertical web, said second connector opening and said second web slot configured to receive a second web fastener, said second web fastener configured to move along a length of said second web slot when said second vertical web element is positioned at different locations along a longitudinal length of said second vertical web, said first and second web fasteners configured to secure said first vertical web element to a single position relative to said second vertical web when said first and second web fasteners are in a fasten position.

17. The method as defined in claim 14, wherein said first and second flanges of said first vertical web element positioned between said first and second flanges of said second vertical web element when said first vertical web element is connected to said second vertical web element.

18. The method as defined in claim 15, wherein said first and second flanges of said first vertical web element positioned between said first and second flanges of said second vertical web element when said first vertical web element is connected to said second vertical web element.

19. The method as defined in claim 16, wherein said first and second flanges of said first vertical web element positioned between said first and second flanges of said second vertical web element when said first vertical web element is connected to said second vertical web element.

20. The method as defined in claim 6, wherein said base portion of said base element includes a base connection arrangement to facilitate in connecting said base element to the existing roofing structure of the building, said base connection arrangement including first and second base slots positioned between a side edge of said base portion and said second vertical web element when said second vertical web element is connected to said base portion.

21. The method as defined in claim 7, wherein said base portion of said base element includes a base connection arrangement to facilitate in connecting said base element to the existing roofing structure of the building, said base connection arrangement including first and second base slots positioned between a side edge of said base portion and said second vertical web element when said second vertical web element is connected to said base portion.

22. The method as defined in claim 16, wherein said base portion of said base element includes a base connection arrangement to facilitate in connecting said base element to the existing roofing structure of the building, said base connection arrangement including first and second base slots positioned between a side edge of said base portion and said second vertical web element when said second vertical web element is connected to said base portion.

23. The method as defined in claim 6, wherein said base portion of said base element includes first and second flanges extending upwardly from a top surface of said base portion, first and second flanges positioned parallel to one another, said first and second flanges connected to said second vertical web element.

24. The method as defined in claim 7, wherein said base portion of said base element includes first and second flanges extending upwardly from a top surface of said base portion, first and second flanges positioned parallel to one another, said first and second flanges connected to said second vertical web element.

25. The method as defined in claim 16, wherein said base portion of said base element includes first and second flanges extending upwardly from a top surface of said base portion, first and second flanges positioned parallel to one another, said first and second flanges connected to said second vertical web element.

26. The method as defined in claim 6, wherein said web connection arrangement includes only one of said arcuate shaped slot and only one of said fastener.

27. The method as defined in claim 7, wherein said web connection arrangement includes only one of said arcuate shaped slot and only one of said fastener.

28. The method as defined in claim 16, wherein said web connection arrangement includes only one of said arcuate shaped slot and only one of said fastener.

29. The method as defined in claim 6, wherein said element portion includes first and second ends, said first vertical web element including first and second sides, said first end of said element portion extending beyond said first side of said vertical web element and said second end of said element portion extending beyond said second side of said vertical web element when a top shaped element is connected to said first vertical web element.

30. The method as defined in claim 7, wherein said element portion includes first and second ends, said first vertical web element including first and second sides, said first end of said element portion extending beyond said first side of said vertical web element and said second end of said element portion extending beyond said second side of said vertical web element when said top shaped element is connected to said first vertical web element.

31. The method as defined in claim 16, wherein said element portion includes first and second ends, said first vertical web element including first and second sides, said first end of said element portion extending beyond said first side of said vertical web element and said second end of said element portion extending beyond said second side of said vertical web element when said top shaped element is connected to said first vertical web element.

* * * * *